US006203281B1

(12) United States Patent
Gurega

(10) Patent No.: US 6,203,281 B1
(45) Date of Patent: Mar. 20, 2001

(54) SUBMERSIBLE PUMP CONTROLLER FOR DIFFERENTIATING FLUIDS

(75) Inventor: Richard R. Gurega, Easton, CT (US)

(73) Assignee: Richal Corporation, Monroe, CT (US)

( * ) Notice: Subject to any disclaimer, the term of this patent is extended or adjusted under 35 U.S.C. 154(b) by 0 days.

(21) Appl. No.: 09/429,969

(22) Filed: Oct. 29, 1999

(51) Int. Cl.[7] ..... F04B 49/04
(52) U.S. Cl. ..... 417/40; 417/44.1
(58) Field of Search ..... 417/44.1, 36, 12, 417/1, 40; 388/80

(56) References Cited

U.S. PATENT DOCUMENTS

| | | | | |
|---|---|---|---|---|
| 4,466,777 | * | 8/1984 | Kimberlin | 417/12 |
| 4,595,341 | * | 6/1986 | Castell-Evans | 417/1 |
| 4,678,403 | * | 7/1987 | Rudy et al. | 417/12 |
| 4,715,785 | * | 12/1987 | Gurega | 417/1 |
| 4,752,188 | * | 6/1988 | Gurega | 417/40 |
| 4,804,936 | * | 2/1989 | Sale | 338/80 |
| 5,049,037 | * | 9/1991 | Carson et al. | 417/36 |
| 5,324,170 | * | 6/1994 | Anastos et al. | 417/12 |
| 5,856,783 | | 1/1999 | Gibb . | |

* cited by examiner

*Primary Examiner*—Charles G. Freay
(74) *Attorney, Agent, or Firm*—Barry R. Lipsitz; Douglas M. McAllister

(57) ABSTRACT

A probe is mounted on a water submersible pump or other fluid handling device housed within a vault for a transformer, elevator or the like. The probe will extend into any water which accumulates in the bottom of the vault enabling a conductive path to be established through an appropriate electric circuit to the pump motor to permit operation of the pump for pumping water from the vault. Oily fluids, which are immiscible in the water and will normally rise to a level above the water level in the vault, will come in contact with the probe to render the probe nonconductive, thereby inactivating the pump circuit. An alarm is provided to indicate the presence of oil in the vault. In order to prevent false alarms when the probe is nonconductive due to immersion in air, a controller is provided to inhibit operation of the alarm unless a float is raised and the probe is nonconductive.

19 Claims, 4 Drawing Sheets

SUBMERSIBLE PUMP CONTROLLER FOR DIFFERENTIATING FLUIDS

BACKGROUND OF THE INVENTION

The present invention relates to submersible pumps, and more particularly to a controller for submersible pumps that can distinguish between fluids such as oil, air and water. By differentiating between different fluids, the pump can be controlled to only pump certain fluids (such as water), and not others (such as oil). Alarms can be generated for fluids that are not to be pumped. False alarms are prevented by distinguishing, for example, between oil and air.

Various industrial applications require submersible pumps. For example, electric utilities commonly use water submersible pumps in transformer vaults for dewatering the vaults. If water accumulates in a transformer vault, it may short a power line causing substantial problems delivering electricity to a consumer. Accordingly, water submersible pumps are commonly placed in the transformer vault to pump out accumulated rainwater and the like which may seep into the vault.

Electrical transformers are normally filled with an oily fluid for lubricating and cooling the various components of the transformer. This oily fluid has a tendency to leak from the transformer housing into the vault. There is a danger to the environment if the oily fluid is pumped with the water into a waste disposal tank or sewer, as such oily fluids usually contain compounds which are harmful to the environment. Further, if the oil admixes with the water and both are pumped to a treatment disposal facility, suitable separation equipment must be provided to separate the oil from the water so that water can readily be disposed of and the oil recycled, or at least stored in a toxic safe facility. Such separation equipment is an item of considerable expense to a utility.

Hydraulic elevators are another application with similar concerns. In particular, the hydraulic oil in the hydraulic shaft tends to leak into the underground vault which houses the elevator piston. This vault may also fill with water during heavy rains due to underground seepage. It is necessary to pump the water out of the vault without pumping the hydraulic oil.

U.S. Pat. Nos. 4,715,785 and 4,752,188 disclose oil detection apparatus for use in controlling submersible pumps. In the systems described in these patents, a probe is mounted on a water submersible pump. The probe extends into any water that accumulates in the bottom of a transformer vault, enabling a conductive path to be established that is used to activate the pump. As the water level falls during pumping, oily fluids, which are immiscible in the water and rise to a level above the water, will come into contact with the probe. Since the oil is not electrically conductive, it breaks the conductive path, thereby stopping the pump.

It is desirable to generate an alarm in the event that a harmful fluid, such as oil, is detected in an underground vault or the like. Such an alarm can be used to identify a potential problem to a central facility, which can dispatch a technician to investigate further. However, false alarms should be prevented. Such false alarms can occur, for example, if the detection of oil relies on the electrical non-conductivity of the oil, since air (which is also non-conductive) may also set of the alarm.

It would be advantageous to provide a method and apparatus to insure that only water is pumped from an industrial vault, without pumping potentially harmful substances such as oil. It would be further advantageous to provide such a method and apparatus in which oil and air are differentiated in order to prevent the occurrence of false alarms.

The present invention provides the aforementioned and other advantages.

SUMMARY OF THE INVENTION

In accordance with the present invention, control apparatus is provided for a submersible pump, valve or the like. Hereinafter, the term "pump" is not used in a limiting sense, and is intended to cover other fluid handling devices, such as valves. The apparatus includes a conductivity probe and a float. A first switch is responsive to the conductivity probe and the float for activating the submersible pump when the probe detects a conductive liquid (such as water) at a first level and the float is raised to a second level above the first level. A second switch is responsive to at least one of the float and the probe for initiating an alarm condition when the probe does not detect a conductive liquid at the first level and the float is raised to the second level.

In an illustrated embodiment, the alarm condition is inhibited whenever the float is below the second level. For example, the first switch can be configured to enable the second switch to operate only when the probe does not detect a conductive liquid at the first level. Alternatively, the second switch can be configured to be directly responsive to both the conductivity probe and the float.

In the illustrated embodiments, the first and second switches comprise relays that are responsive to controllers.

A method is provided for differentiating fluids in which a submersible pump is submerged. The results are used to control the operation of the pump and an alarm. In accordance with the method, a determination is made as to whether a fluid at a first level above a base of the pump is conductive. A determination is also made as to when the fluid in which the pump is submerged is a liquid which reaches a second level above the first level. A submersible pump is activated when the fluid at the first level is conductive and the liquid reaches the second level. The submersible pump is prevented from running when the fluid at the first level is nonconductive. An alarm condition is initiated when the fluid at the first level is nonconductive and the liquid reaches the second level. The alarm condition is inhibited when the fluid at the first level is nonconductive and no liquid has reached the second level.

In the illustrated embodiments, a probe is used in the first determining step to determine the conductivity of the fluid. A float is used in the second determining step to determine when the liquid reaches the second level.

DETAILED DESCRIPTION OF THE INVENTION

In accordance with the invention, an oil/air/water detection apparatus is provided for use in an industrial vault or the like. During normal operation, when water enters the vault and rises to a first level, the conductivity of the water shorts an electrical probe which closes the contacts in a first switch. As the water continues to rise, it lifts a float which, in combination with the contact shorted by the probe, activates a pump, valve, motor or the like.

During abnormal operation, in which a nonconductive fluid such as oil is present, the probe is insulated and does not conduct. As the fluid continues to rise, it lifts the float to the second level which, in conjunction with the nonconductive probe, sets off an alarm. The alarm may be local or remote. For example, a remote alarm may be provided at a central facility from which technicians are dispatched to correct the abnormality that resulted in setting off the alarm.

In a situation where there is no oil or water present at the probe, but only air, the probe will not conduct. This could occur, for example, after the initial installation of a vault before any water has entered, in which case the probe will be nonconductive since it is surrounded only by air. Even after water and/or oil has entered the vault above the level at which the probe is mounted, evaporation may take place which causes the level of the fluid to drop below the probe. In this case, the probe is again nonconductive since it is only surrounded by air. If only the conductivity of the probe is used to signal an alarm, false alarms will be generated which will cause needless concern and/or result in the dispatching of a technician for nothing.

The present invention avoids the generation of false alarms by monitoring both the conductivity of the probe as well as the level of the float in order to distinguish air from oil. In particular, where nonconductivity of the probe is caused by oil, once the oil rises to the second level where the float is raised, the float will actuate a switch which, in combination with the nonconductivity determined by the probe, can set off an alarm. Where the nonconductivity of the probe is caused by air, the float will not be raised by the air and the float switch will not be actuated. Thus, an alarm will not be triggered.

Figure 1:
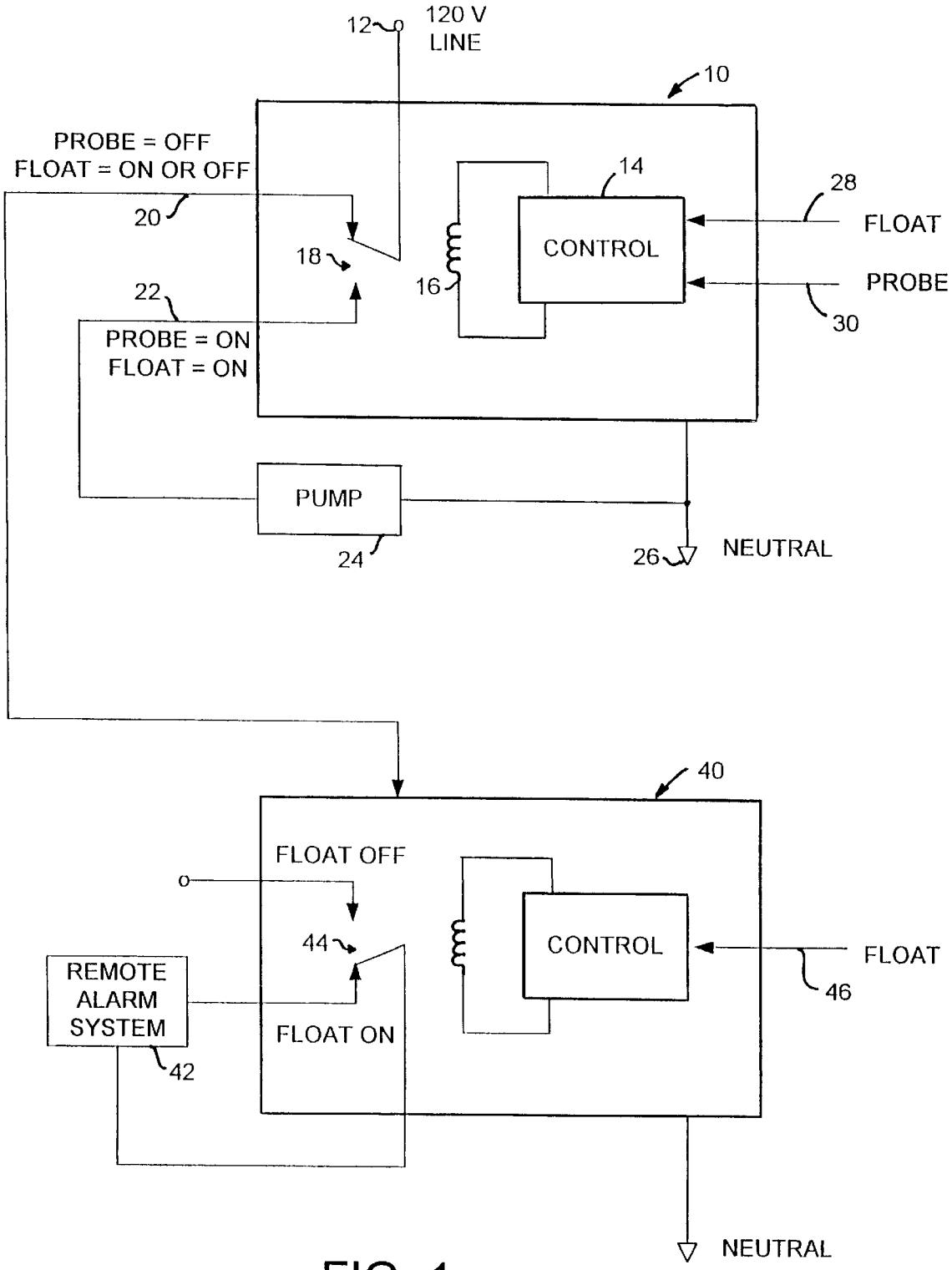
FIG. 1 is a block diagram illustrating a pump and alarm controller in accordance with the present invention.

One embodiment of a control system in accordance with the present invention is illustrated schematically in FIG. 1. A first relay generally designated 10 includes a controller 14 which either energizes or de-energizes a relay coil 16 in accordance with predetermined conditions. The controller 14 receives input from a float switch via line 28 and from a probe via line 30. When the probe is off (i.e., nonconductive), coil 16 is in a condition that will cause switch 18 to couple power from a terminal 12 via line 20 to a second relay unit 40. When the probe is on (i.e., conductive) due to the presence of water, and the float is also on due to the water having reached a second level above the first level at which the probe is mounted, controller 14 will place coil 16 into a condition that will actuate switch 18 such that the power from terminal 12 is disconnected from second relay 40 and connected instead to a pump (or other fluid handling device) 24 via line 22. The other end of pump 24 is coupled to neutral 26. Thus, pump 24 will have the voltage input at terminal 12 across it, and will run in order to pump the water out from the vault in which the pump, float and probe are contained.

It will be appreciated by those skilled in the art that the switch 18 can be configured such that it is in the position shown when coil 16 is de-energized. Alternatively, the switch 18 can be configured such that it is in the position shown only when coil 16 is energized. Since the pump will generally only run intermittently, the preferred embodiment is to configure the relay 10 such that switch 18 is in the position shown when coil 16 is de-energized, and will actuate the pump 24 when coil 16 is energized.

In order to provide an alarm (which can be local and/or remote), second relay 40 is actuated by the float switch via line 46. Relay 40 will only be operational if it receives power from relay 10 via line 20. As indicated above, this will only occur when the probe in nonconductive (i.e., when the probe is immersed in air or oil, and not water). Thus, when relay 40 is energized, and the float has been lifted by a liquid in order to actuate its associated float switch (i.e., the float is "on"), an alarm system 42 will be actuated by switch 44. On the other hand, if the float has not been raised and its associated float switch is "off", the alarm system 42 will not be actuated by switch 44. This situation will occur if the probe is nonconductive (i.e., "off") due to its immersion in air. In this case, the air will not lift the float, and even though the probe is off, the alarm will not be triggered because there is no liquid in the vault to raise the float.

It is noted that although a remote alarm system 42 is illustrated in the figures, a local alarm system can also be provided either instead of or in addition to the remote alarm system. Such a local alarm system would operate in the same manner, and be triggered by switch 44 when the probe is off and the float is on.

Figure 2:
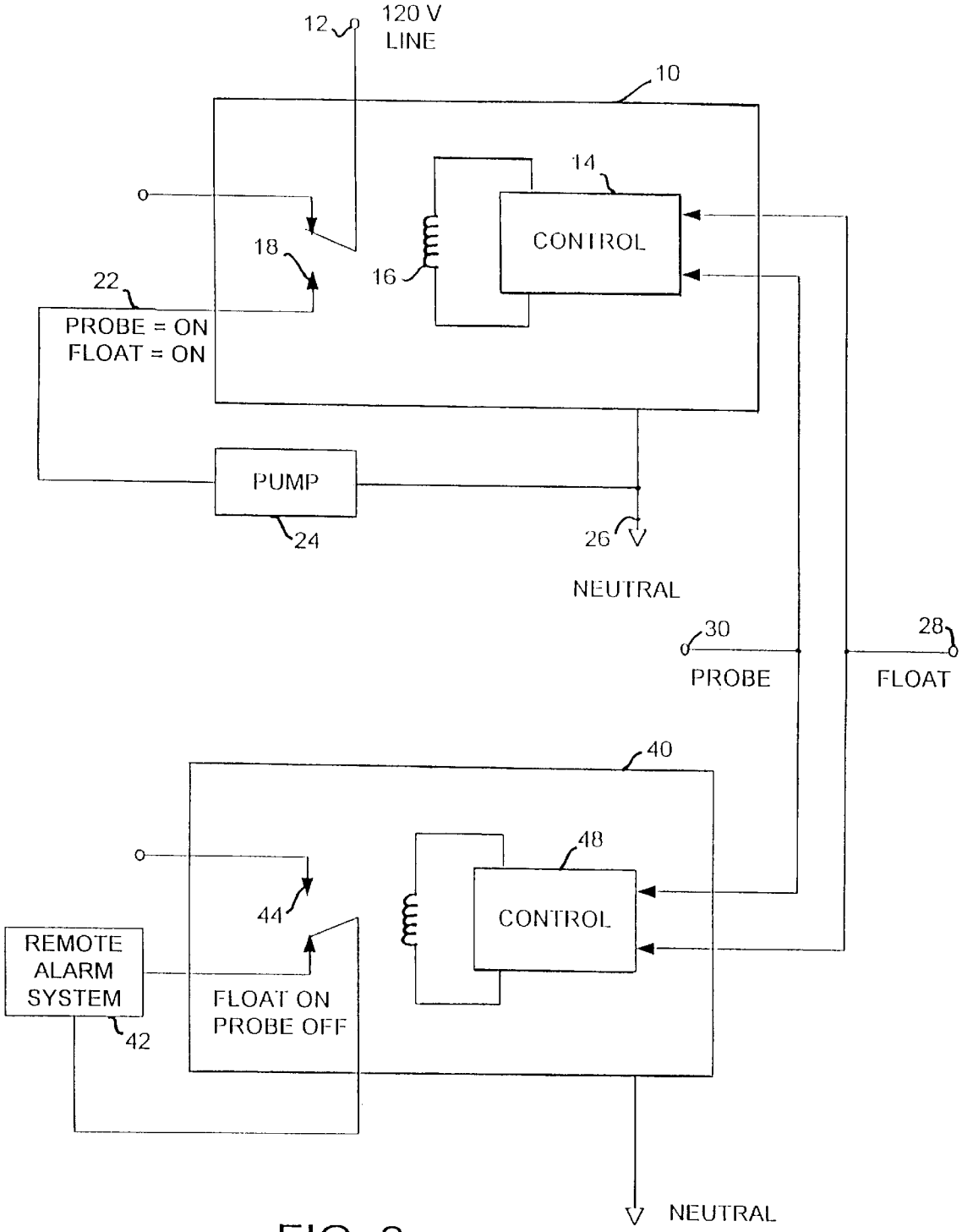
FIG. 2 is a block diagram illustrating an alternate embodiment of the pump and alarm controller of FIG. 1.

FIG. 2 illustrates an alternate embodiment in which power to the relay 40 is not obtained from the relay 10. Instead, relay 40 is coupled to its own power source (not shown). In this embodiment, the controllers of both relays 10 and 40 receive both the probe signal via terminal 30 and the float signal via terminal 28. The controller 14 of relay 10 turns on the pump when both the probe and float are on. The controller 48 of relay 40 turns on the alarm system 42 via switch 44 only when the float is on but the probe is off. Thus, the alarm will only be triggered when the probe is immersed in oil, and not when it is merely immersed in air.

Figure 3:
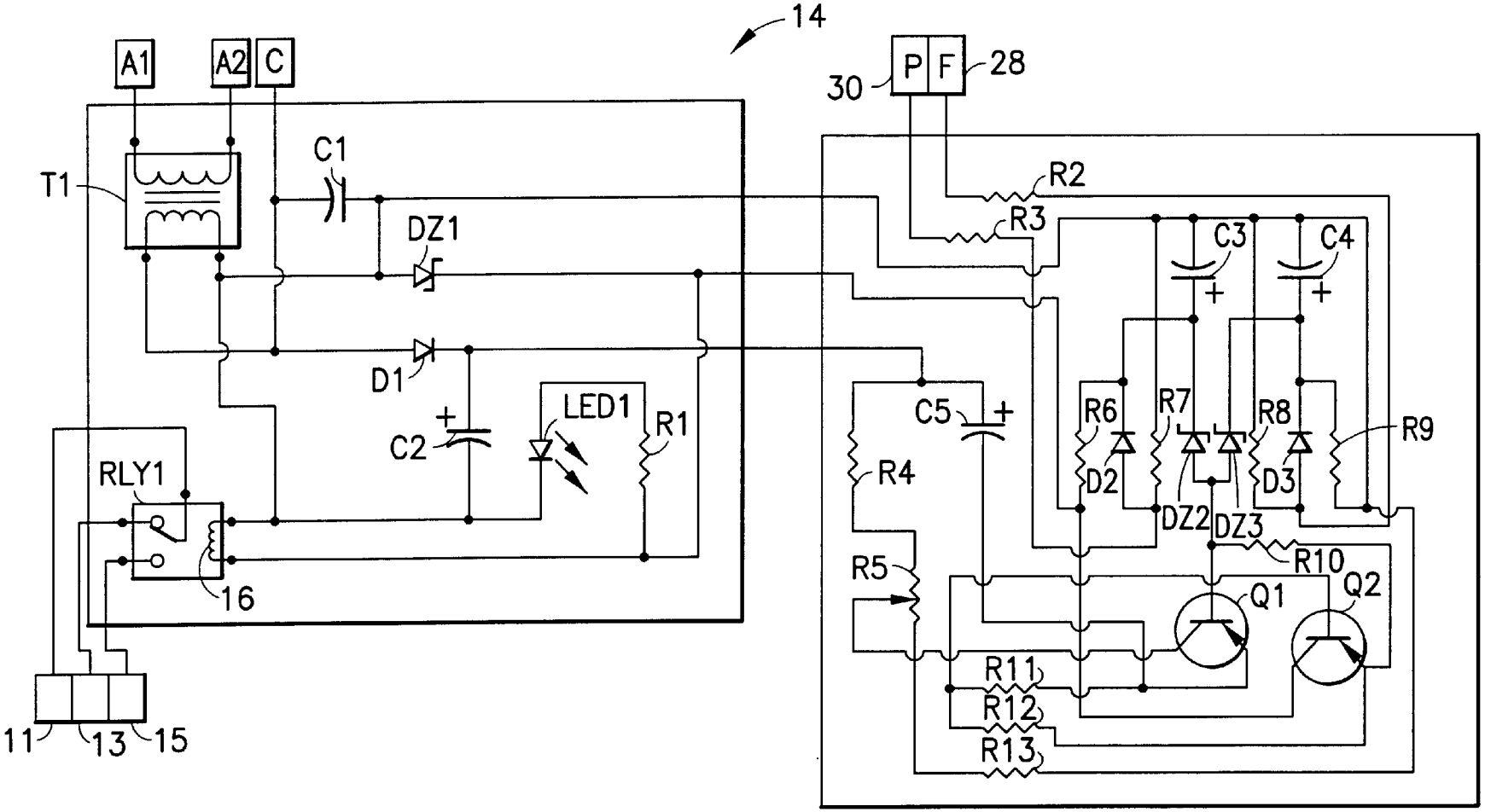
FIG. 3 is a schematic diagram showing an example implementation of a controller for one of the relays of FIG. 1.

FIG. 3 illustrates one possible embodiment of a relay controller such as the control 14 illustrated in FIGS. 1 and 2. The control used for relay 40 can be identical.

In the controller illustrated in FIG. 3, power is supplied through terminals A1 and A2. A transformer T1 is used to step the line voltage down to, for example, 17.5 volts AC. Diode D1 and capacitor C2 are used to rectify and filter the output of transformer T1. Capacitor C1 is used to establish a common for the float switch and probe. The probe is coupled via terminal 30 to a current limiting sensing resistor R3. Similarly, the float switch is coupled via terminal 28 to a current limiting sensing resistor R2. The output of the probe and float switch pass through respective diodes D2 and D3, respectively, for comparison with respective reference voltages established by Zener diodes DZ2 and DZ3. The result of this comparison and the value of potentiometer R5 (which provides a sensitivity adjustment) determine the state of transistors Q1 and Q2. The coil 16 of the relay (RLY1) is actuated by transistor Q1 when the probe and float are both on.

It should be appreciated that the circuit of FIG. 3 can be configured to actuate the coil 16 under different conditions, for example, when the float is on without regard for the condition of the probe, as illustrated for relay 40 in FIG. 1. The output device (e.g., pump or alarm) will be actuated by appropriate terminals 11, 13 and/or 15 depending on whether normally closed or normally opened operation is desired.

Figure 4:
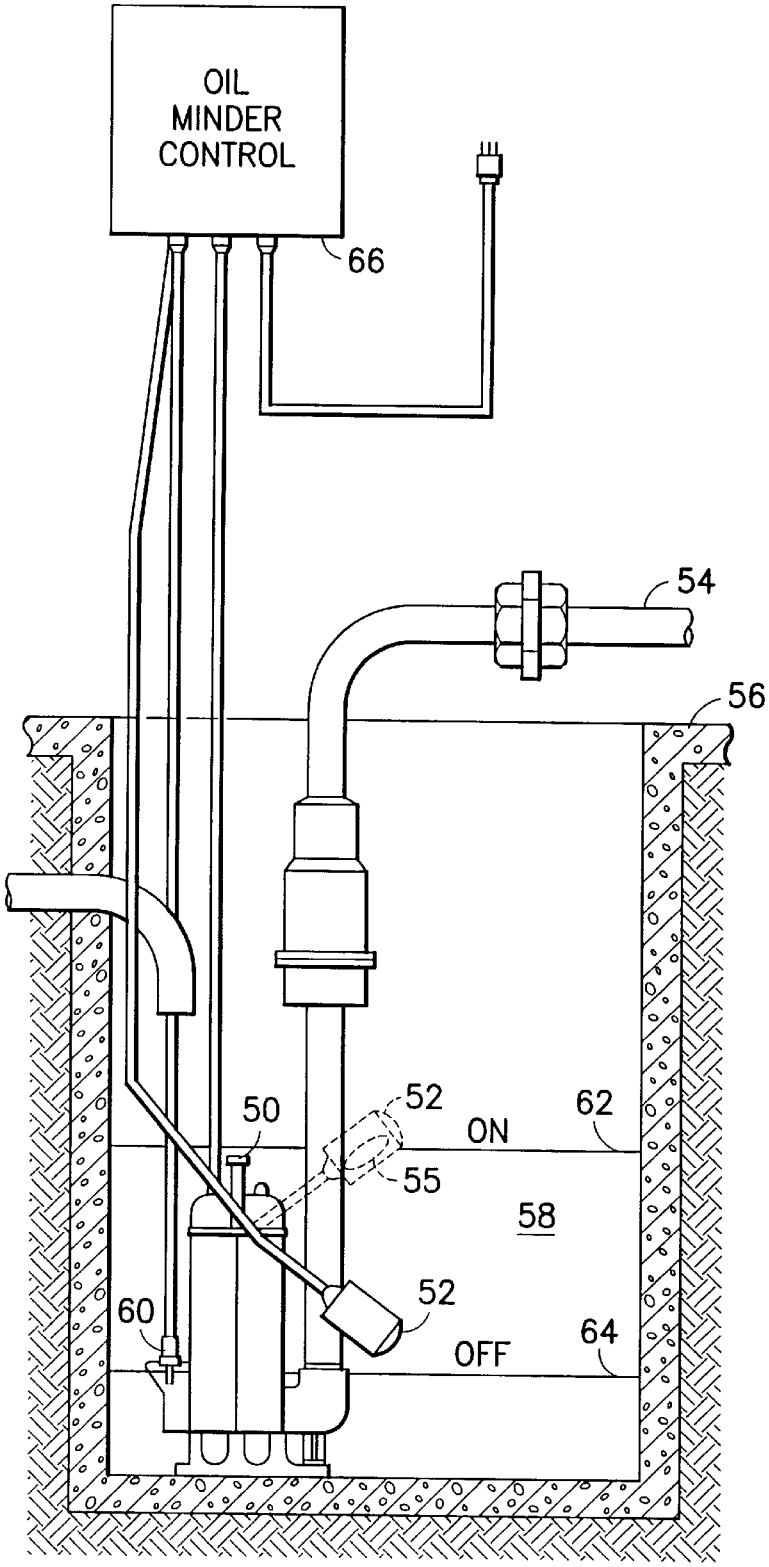
FIG. 4 is a diagram illustrating the operation of a submersible pump in accordance with the invention.

FIG. 4 illustrates the operation of a submersible pump in accordance with the present invention. Pump 50 includes a float 52 which will actuate a float switch 55 when it is raised by a liquid 58 to the level 62. When liquid is below this level, for example at level 64, the float will not be raised to a point at which the float switch is actuated. The float switch can comprise, for example, a mercury switch 55 or the like within the float as shown in FIG. 4. Alternatively, a mechanical switch, Hall effect sensor, reed switch, or the like could be adapted for activation by the float in a well known manner. The pump assembly is submersed within a vault 56 in order to pump liquid from the vault via a pipe 54.

Probe 60 is provided in accordance with the invention to determine whether the liquid 58 is conductive (e.g., water) or nonconductive (e.g., oil). An oil minder control 66 incorporates a relay system as illustrated, for example, in FIG. 1 or FIG. 2, in order to distinguish between air and oil at the level of probe 60 as explained above.

In operation, if probe 60 is nonconductive and float 52 has not been raised to the level 62, no alarm will be generated. This will occur either if the probe 60 is nonconductive due to the presence of air, or if probe 60 is nonconductive due to the presence of oil. On the other hand, if probe 60 is nonconductive and the float 52 has been raised to the level 62, the float will actuate the alarm due to the nonconductive state of probe 60 and the actuation of float switch 55.

It should now be appreciated that the present invention provides an improved oil detection apparatus for submersible pumps in which an alarm condition is only generated when oil is present. If probe 60 is nonconductive only due to the presence of air, which is a fluid that will not raise the float 52, an alarm will not be generated.

Although the invention has been described in connection with various preferred embodiments, it should be appreciated that numerous adaptations and modifications may be made thereto without departing from the spirit and scope of the invention as set forth in the claims.

What is claimed is:

1. A control apparatus for a submersible pump, wherein the pump is adapted to be placed in a walled housing, and the housing is exposed to air but is susceptible to the accumulation of both conductive and non-conductive liquids therein, comprising:

a float that indicates whether air in the housing has been displaced by a predetermined level of at least one of the conductive and non-conductive liquids that have accumulated in the housing;

a conductivity probe positionable at a probe level that is below the predetermined level, for detecting whether the conductive liquid is present at the probe level;

wherein an intake of the pump is positioned below the probe level; and means for triggering an alarm when the float indicates that at least one of the liquids is present at the predetermined level, and the conductivity probe does not detect the presence of the conductive liquid at the probe level, thereby indicating that the non-conductive liquid is present in the housing, at least between the probe level and the predetermined level.

2. The apparatus of claim 1, further comprising:

means responsive to said triggering means for precluding the pump from pumping the non-conductive liquid from the housing.

3. The apparatus of claim 1, wherein:

the accumulation of the non-conductive liquid in the housing is due to leakage from machinery associated with the housing.

4. The apparatus of claim 1, wherein:

the accumulation of the conductive liquid in the housing is due to entry of water into the housing.

5. The apparatus of claim 1, wherein:

said alarm is inhibited when said float does not indicate that at least one of the liquids has reached the predetermined level.

6. The apparatus of claim 1, further comprising:

a first switch responsive to said conductivity probe and said float for activating the pump when said probe detects the conductive liquid at the probe level and said float indicates that at least one of the liquids has reached the predetermined level.

7. The apparatus of claim 6, further comprising:

a second switch responsive to said conductivity probe and said float that is activated to preclude the pump from pumping the non-conductive liquid from the housing when said probe does not detect the conductive liquid at the probe level, and said float indicates that at least one of the liquids has reached the predetermined level.

8. The apparatus of claim 7, wherein:

said first switch enables said second switch to operate only when said probe does not detect the conductive liquid at the probe level.

9. The apparatus of claim 7, wherein:

said second switch is directly responsive to both said conductivity probe and said float.

10. The apparatus of claim 7, wherein:

said first and second switches comprise relays.

11. The apparatus of claim 10, wherein:

said relays are responsive to controllers.

12. A method for controlling a submersible pump, wherein the pump is adapted to be placed in a walled housing, and the housing is exposed to air but is susceptible to the accumulation of both conductive and non-conductive liquids therein, comprising the steps of:

determining whether air in the housing has been displaced by a predetermined level of at least one of the conductive and non-conductive liquids that have accumulated in the housing;

detecting whether the conductive liquid is present at a probe level that is below the predetermined level;

wherein an intake of the pump is positioned below the probe level; and triggering an alarm when it is determined that at least one of the liquids is present at the predetermined level, and the presence of the conductive liquid at the probe level is not detected, thereby indicating that the non-conductive liquid is present in the housing, at least between the probe level and the predetermined level.

13. The method of claim 12, comprising the further step of:

precluding the pump from pumping the non-conductive liquid from the housing when the alarm is triggered.

14. The method of claim 12, wherein:

the accumulation of the non-conductive liquid in the housing is due to leakage from machinery associated with the housing.

15. The method of claim 12, wherein:

the accumulation of the conductive liquid in the housing is due to entry of water into the housing.

16. The method of claim 12, wherein:

said alarm is inhibited when said float does not indicate that at least one of the liquids has reached the predetermined level.

17. The method of claim 12, comprising the further step of:

activating the pump when the conductive liquid is detected at the probe level and it is determined that at least one of the liquids has reached the predetermined level.

18. The method of claim 12, comprising the further step of:

activating a switch to preclude the pump from pumping the non-conductive liquid from the housing when the conductive liquid is not detected at the probe level, and it is determined that at least one of the liquids has reached the predetermined level.

19. The method of claim 18, wherein:

the switch is activated only when the conductive liquid is not detected at the probe level.

* * * * *